US008190045B2

(12) United States Patent
Murauchi et al.

(10) Patent No.: US 8,190,045 B2
(45) Date of Patent: May 29, 2012

(54) DEVELOPING DEVICE AND IMAGE FORMING APPARATUS

(75) Inventors: Junji Murauchi, Toyokawa (JP); Megumi Minami, Amagasaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 677 days.

(21) Appl. No.: 12/336,225

(22) Filed: Dec. 16, 2008

(65) Prior Publication Data

US 2009/0214232 A1 Aug. 27, 2009

(30) Foreign Application Priority Data

Feb. 21, 2008 (JP) ..... 2008-039745

(51) Int. Cl.
*G03G 15/10* (2006.01)

(52) U.S. Cl. ..... 399/59

(58) Field of Classification Search ..... 399/30, 399/59

See application file for complete search history.

(56) References Cited

FOREIGN PATENT DOCUMENTS

| | | |
|---|---|---|
| JP | 59-100471 A | 6/1984 |
| JP | 08-234556 | 9/1996 |
| JP | 2003-186259 | 7/2003 |
| JP | 2005-134796 | 5/2005 |
| JP | 2005-292511 | 10/2005 |

OTHER PUBLICATIONS

Machine translation of JP 08-234556 A obtained on Jul. 26, 2011.*
Notification of Reason for Refusal issued in the corresponding Japanese Patent Application No. 2008-039745 dated Feb. 9, 2010, and an English Translation thereof.

* cited by examiner

*Primary Examiner* — David Gray
*Assistant Examiner* — Gregory H Curran
(74) *Attorney, Agent, or Firm* — Buchanan Ingersoll & Rooney PC

(57) ABSTRACT

A developing including a developer replenishing tank for replenishing a replenishment developer to a developer tank; a toner concentration detecting sensor; a discharging mechanism for discharging an excessive amount of the developer-tank-contained developer outside the developer tank when the amount of the developer-tank-contained developer inside the developer tank exceeds a predetermined amount; and control unit having a memory for storing the current toner concentration inside the developer tank, the reference toner concentration inside the developer tank, a corrected reference toner concentration calculated according to the formula of (the current toner concentration —a correction value), a predetermined replenishment amount to the developer tank and an allowable value for the current toner concentration with respect to the reference toner concentration, and a computer for calculating the corrected reference toner concentration and comparing the current toner concentration with the reference toner concentration and the corrected reference toner concentration.

14 Claims, 6 Drawing Sheets

DEVELOPING DEVICE AND IMAGE FORMING APPARATUS

This application is based on applications No. 2008-039745 filed in Japan, the contents of which are hereby incorporated by reference.

BACKGROUND OF THE INVENTION

1. Field of the Invention

The present invention relates to a developing device for use in an electrophotographic image forming apparatus and to an image forming apparatus incorporating the developing device. More particularly, the present invention relates to a trickle developing device that gradually supplies fresh developer and gradually discharge deteriorated developer and to an image forming apparatus incorporating the developing device.

2. Description of the Related Art

As developing systems employed for electrophotographic image forming apparatuses, the one-component developing system in which toner is used as the main component of the developer and the two-component developing system in which toner and carrier are used as the main components of the developer are known.

The two-component developing system that uses toner and carrier, in which the toner and carrier are charged by friction contact therebetween to predetermined polarities, has a characteristic that the stress on the toner is less than that in the one-component developing system that uses a one-component developer. Since the surface area of the carrier is larger than that of the toner, the carrier is less contaminated with the toner attached to the surface thereof. However, with the use for a long period, contamination (spent) attached to the surface of the carrier increases, whereby the capability of charging the toner is reduced gradually. As a result, problems of photographic fog and toner scattering occur. Although it is conceivable that the amount of the carrier stored in a two-component developing device is increased to extend the life of the developing device, this is undesirable because the developing device becomes larger in size.

To solve the problems encountered in the two-component developer, Patent document 1 discloses a trickle developing device being characterized in that fresh developer is gradually replenished into the developing device and developer deteriorated in charging capability is gradually discharged from the developing device, whereby the increase of the deteriorated carrier is suppressed. The developing device is configured to maintain the volume level of the developer inside the developing device approximately constant by discharging an excessive amount of deteriorated developer using the change in the volume of the developer. In the trickle developing device, the deteriorated carrier inside the developing device is gradually replaced with fresh carrier, and the charging performance of the carrier inside the developing device can be maintained approximately constant.

[Patent document 1] Japanese Patent Application Laid-Open Publication No. Sho 59-100471

However, since the volume of the developer inside the developing device changes depending on the state of the developer inside the developing device, that is, the concentration of the toner and the deteriorated state of the carrier, the ratio of the ingredients constituting the developer becomes different even if the volume of the developer remains the same.

The concentration of the toner inside the developing device is detected using, for example, a toner concentration detecting sensor that detects the permeability of the developer. For this reason, the measurement accuracy of the toner concentration detecting sensor is not sufficiently high, and the toner concentration indicated as a measured value may be different from the true toner concentration. In addition, the toner concentration obtained using the toner concentration detecting sensor may indicate a toner concentration different from the true toner concentration depending on the filling state of the developer around the toner concentration detecting sensor and the changes in the ambient environment of the image forming apparatus.

Because of various factors such as those described above, the toner concentration obtained using the toner concentration detecting sensor may be detected to be higher than a reference toner concentration that is assumed to be appropriate. Since the trickle developing device is controlled such that the volume level of the developer inside the developing device is maintained approximately constant, if the toner concentration is detected to be high for some reason, the developer is not replenished for a while and ordinary image formation is carried out continuously until the toner concentration inside the developing device returns to the appropriate reference toner concentration. When the other concentration inside the developing device has returned to the reference toner concentration, the amount of the toner inside the developing device, that is, the amount of the developer, has become scarce, and the volume level of the developer inside the developing device has lowered. The fact that the volume level of the developer inside the developing device has lowered indicates that the developer inside the developing device is insufficient. A stirring screw is used to stir the developer inside the developing device, and the stirring screw is usually disposed along the developing roller to convey the developer in the longitudinal direction of the developing roller while stirring the developer. When the developer is conveyed using the stirring screw in this state, the low concentration portion of the developer is also moved as the spiral of the screw is moved, whereby uneven supply to the developing roller corresponding to the movement of the screw occurs. As a result, the influence of the uneven supply of the toner appears on formed images. Hence, in the conventional trickle developing device, the so-called screw irregularity phenomenon reflecting the uneven supply of the toner due to the use of the stirring screw occurs, and there is a problem of being unable to maintain high-quality images.

Accordingly, the technical problem to be solved by the present invention is to provide a developing device and an image forming apparatus capable of carrying out excellent image formation for a long period by making the fluctuations in the toner concentration and the volume level of the developer inside a trickle developing device that uses a two-component developer as small as possible.

SUMMARY OF THE INVENTION

To solve the above-mentioned technical problem, the present invention provides a developing device having stirring members for stirring a developer-tank-contained developer containing toner and carrier inside a developer tank while conveying the developer and a developer holder disposed adjacent to the stirring members to supply the stirred developer-tank-contained developer to an electrostatic latent image holder, comprising:

a developer replenishing tank for replenishing the toner and the carrier to the developer tank, a toner concentration detecting sensor for detecting the current toner concentration inside the developer tank, a discharging mechanism provided in the developer tank to discharge an excessive amount of the developer-tank-contained developer outside the developer tank when the amount of the developer-tank-contained developer inside the developer tank exceeds a predetermined amount, and control unit for carrying out control to replenish the toner and the carrier from the developer replenishing tank to the developer tank when the current toner concentration detected using the toner concentration detecting sensor is lower than a predetermined reference toner concentration, wherein when a toner concentration higher than the reference toner concentration by a predetermined value or more is detected as the current toner concentration, the control unit corrects the reference toner concentration to a corrected reference toner concentration higher than the reference toner concentration and changes the corrected reference toner concentration so that the corrected reference toner concentration gradually lowers to the value of the reference toner concentration.

In the above-mentioned developing device, when it is detected that the current toner concentration inside the developer tank is higher than the reference toner concentration by the predetermined value or more, the reference toner concentration is corrected to the corrected reference toner concentration such that the corrected reference toner concentration>the reference toner concentration is established, whereby the reference toner concentration serving as the corrected reference toner concentration is brought close to the current toner concentration and replenishment operation is facilitated. When the current toner concentration becomes lower than the corrected reference toner concentration, a predetermined amount of a replenishment developer is replenished, and the lowered volume level inside the developer tank rises. Conventionally, replenishment operation is not carried out until the current toner concentration becomes lower than the reference toner concentration, whereby the volume level of the developer inside the developer tank lowers remarkably; on the other hand, in the present invention, replenishment operation is carried out when the current toner concentration becomes lower than the corrected reference toner concentration, whereby the volume level of the developer inside the developer tank can be prevented from lowering. As a result, excellent image formation can be carried out for an extended period. The current toner concentration inside the developer tank lowers in the process that the toner inside the developer tank is consumed for ordinary image formation. As the current toner concentration lowers, the value of the corrected reference toner concentration is lowered gradually to the value of the reference toner concentration in the end, thereby returning to the original reference toner concentration.

The corrected reference toner concentration is a value obtained by subtracting a predetermined value (a correction value described later) from the current toner concentration that is detected being higher than the reference toner concentration by the predetermined value or more.

Although various embodiments can be implemented in order that the control unit corrects the corrected reference toner concentration, the control unit corrects the corrected reference toner concentration to a lower value each time predetermined amounts of the toner and the carrier are replenished to the developer tank.

As another embodiment in which the control unit corrects the corrected reference toner concentration, the developing device further comprises a developer discharge detecting sensor to detect whether the developer-tank-contained developer has been discharged from the discharging mechanism, and the control unit corrects the corrected reference toner concentration to a lower value each time the developer discharge detecting sensor detects the discharge of the developer-tank-contained developer.

As still another embodiment in which the control unit corrects the corrected reference toner concentration, the control unit gradually corrects the value of the corrected reference toner concentration to lower values with the passage of time.

The above-mentioned developing device is incorporated and used in an image forming apparatus comprising a rotatable electrostatic latent image holder for holding electrostatic latent images on the circumferential face thereof, stirring members for stirring a developer-tank-contained developer containing toner and carrier inside a developer tank while conveying the developer, and a developer holder disposed adjacent to the stirring members to supply the stirred developer-tank-contained developer to the electrostatic latent image holder.

As yet still another embodiment in which the control unit of the image forming apparatus corrects the corrected reference toner concentration, the control unit gradually corrects the value of the corrected reference toner concentration to lower values depending on the number of image formation operations.

DESCRIPTION OF THE PREFERRED EMBODIMENT

Figure 1:
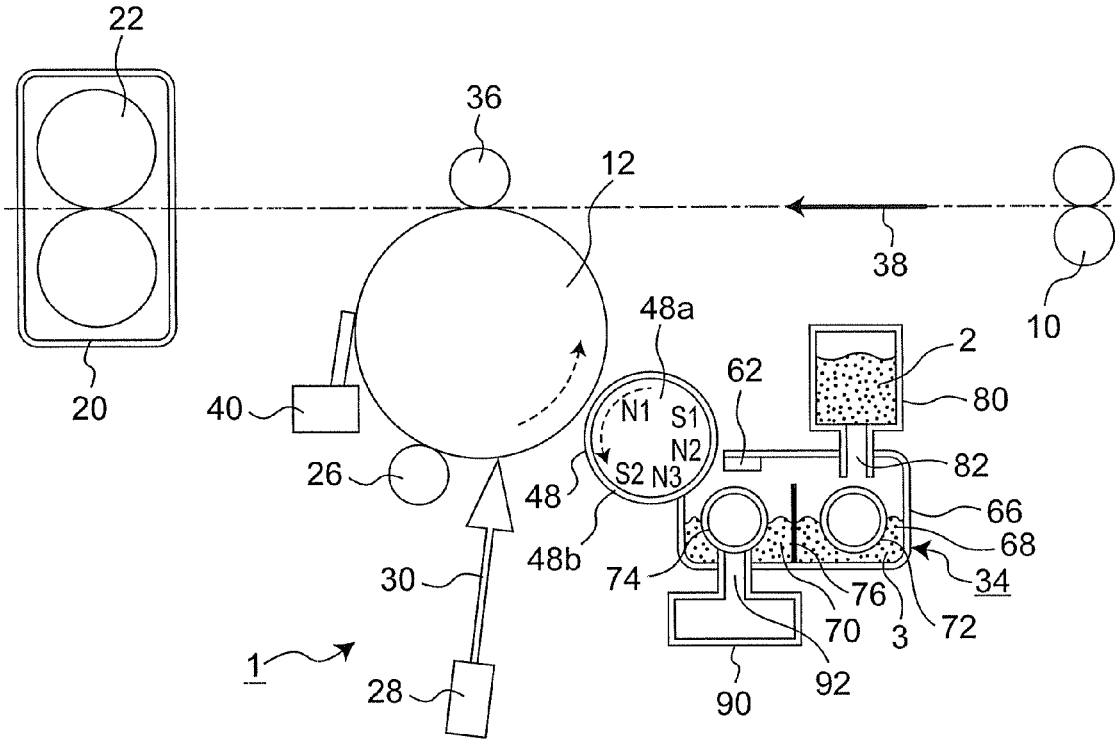
FIG. 1 is a view showing the schematic configuration of an image forming apparatus according to a first embodiment of the present invention.

Preferred embodiments according to the present invention will be described below referring to the accompanying drawings. Although terms meaning specific directions (for example, "above," "below," "left" and "right" and other terms including these, and "clockwise" and "counterclockwise") are used in the following description, they are used for purposes of facilitating the understanding of the present invention referring to the drawings, and it should not be construed that the present invention is limited by the meanings of the terms. Furthermore, in an image forming apparatus 1 and a developing device 34 described below, identical or similar components are designated by the same reference numerals.

The image forming apparatus 1 and the developing device 34 incorporated therein according to a first embodiment of the present invention will be described referring to FIGS. 1 to 3.

[Image Forming Apparatus]

FIG. 1 shows the components relating to image formation in the electrophotographic image forming apparatus 1 according to the present invention. The image forming apparatus 1 may be a copier, a printer, a facsimile machine or a compound machine combinedly equipped with the functions of these. The image forming apparatus 1 has a photosensitive member 12 serving as an electrostatic latent image holder. Although the photosensitive member 12 is formed of a cylinder in this embodiment, the photosensitive member 12 is not limited to have such a shape in the present invention, but it is possible to use an endless belt-type photosensitive member instead. The photosensitive member 12 is connected to a motor (not shown) so as to be driven and is rotated on the basis of the driving of the motor in the direction indicated by the arrow. Around the circumference of the photosensitive member 12, a charging device 26, an exposure device 28, a developing device 34, a transfer device 36 and a cleaning device 40 are respectively arranged along the rotation direction of the photosensitive member 12.

The charging device 26 charges the photosensitive layer, that is, the outer circumferential face of the photosensitive member 12, to a predetermined potential. Although the charging device 26 is represented as a cylindrical roller in this embodiment, instead of this, it is also possible to use charging devices of other forms (for example, a rotary or fixed brush type charging device and a wire discharging type charging device). The exposure device 28 disposed at a position close to or away from the photosensitive member 12 emits image light 30 toward the outer circumferential face of the charged photosensitive member 12. An electrostatic latent image having an area wherein the image light 30 is projected and the charged potential is attenuated and an area wherein the charged potential is almost maintained is formed on the outer circumferential face of the photosensitive member 12 that has passed the exposure device 28. In this embodiment, the area wherein the charged potential is attenuated is the image area of the electrostatic latent image, and the area wherein the charged potential is almost maintained is the non-image area of the electrostatic latent image. The developing device 34 develops the electrostatic latent image into a visible image using a developer-tank-contained developer 3 described later. The details of the developing device 34 are described later. The transfer device 36 transfers the visible image formed on the outer circumferential face of the photosensitive member 12 onto paper 38 or film. Although the transfer device 36 is shown as a cylindrical roller in the embodiment shown in FIG. 1, it is also possible to use transfer devices having other forms (for example, a wire discharging type transfer device). The cleaning device 40 recovers non-transferred toner not transferred to the paper 38 by the transfer device 36 but remaining on the outer circumferential face of the photosensitive member 12 from the outer circumferential face of the photosensitive member 12. Although the cleaning device 40 is shown as a plate-like blade in this embodiment, instead of this, it is also possible to use cleaning devices having other forms (for example, a rotary or fixed brush-type cleaning device).

When the image forming apparatus 1 configured as described above forms an image, the photosensitive member 12 is rotated counterclockwise, for example, on the basis of the driving of the motor (not shown). At this time, the outer circumferential area of the photosensitive member 12 passing the charging device 26 is charged to a predetermined potential at the charging device 26. The outer circumferential area of the charged photosensitive member 12 is exposed to the image light 30 at the exposure device 28, and an electrostatic latent image is formed. As the photosensitive member 12 is rotated, the electrostatic latent image is conveyed to the developing device 34 and developed into a visible image using the developing device 34. As the photosensitive member 12 is rotated, the toner image developed into the visible image is conveyed to the transfer device 36 and transferred to the paper 38 using the transfer device 36. The paper 38 to which the toner image is transferred is conveyed to a fixing device 20, and the toner image is fixed to the paper 38. The outer circumferential area of the photosensitive member 12 having passed the transfer device 36 is conveyed to the cleaning device 40 in which the toner not transferred to the paper 38 but remaining on the outer circumferential face of the photosensitive member 12 is scraped off from the photosensitive member 12.

[Developing Device]

The developing device 34 is provided with a two-component developer containing non-magnetic toner (hereafter simply referred to as toner) and magnetic carrier (hereafter simply referred to as carrier) and a developer tank 66 accommodating various members. The developer tank 66 has an opening section being open toward the photosensitive member 12, and a developing roller 48 is installed in a space formed near the opening section. The developing roller 48 serving as a developer holder is a cylindrical member that is rotatably supported in parallel with the photosensitive member 12 while having a predetermined developing gap to the outer circumferential face of the photosensitive member 12.

The developing roller 48 is the so-called magnetic roller having a magnet 48*a* secured so as not to be rotatable and a cylindrical sleeve 48*b* (first rotating cylinder) supported so as to be rotatable around the circumference of the magnet 48*a*. Above the sleeve 48*b* of the developing roller 48, a regulating plate 62 secured to the developer tank 66 and extending in parallel with the center axis of the sleeve 48*b* of the developing roller 48 is disposed so as to be opposed thereto with a predetermined regulating gap therebetween. The magnet 48*a* disposed inside the developing roller 48 has five magnetic poles N1, S2, N3, N2 and S1 in the rotation direction of the sleeve 48*b*. Among these magnetic poles, the main magnetic pole N1 is disposed so as to be opposed to the photosensitive member 12. The magnetic poles N2 and N3 having the same polarity and generating a repulsive magnetic field for detaching the developer from the surface of the sleeve 48*b* are disposed so as to be opposed to each other inside the developer tank 66. The sleeve 48*b* of the developing roller 48 rotates in the direction opposite to the rotation direction of the photosensitive member 12 (counter direction).

Figure 2:
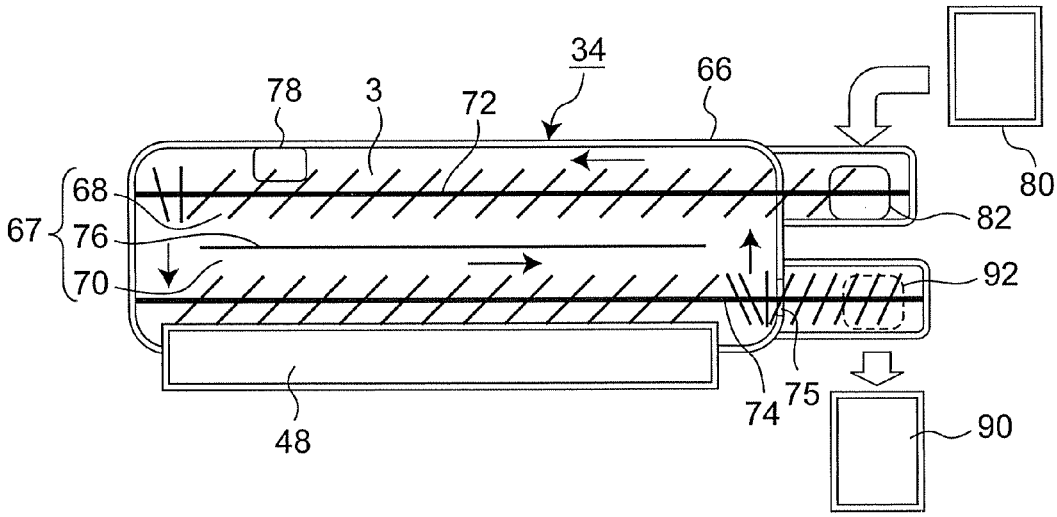
FIG. 2 is a schematic sectional view showing the developing device of the image forming apparatus shown in FIG. 1 as seen from above.

FIG. 2 is a schematic sectional view showing the developing device 34 as seen from above. As shown in FIG. 2, a developer stirring and conveying chamber 67 is formed behind the developing roller 48. The developer stirring and conveying chamber 67 comprises a second conveying passage 70 formed near the developing roller 48, a first conveying passage 68 formed away from the developing roller 48 and a partition wall 76 for partitioning the space between the first conveying passage 68 and the second conveying passage 70. Above the upstream side of the conveying direction of the first conveying passage 68, a developer replenishing tank 80 is disposed and communicates with the first conveying passage 68 via a replenishing port 82. The developer replenishing tank 80 is filled with a replenishment developer 2 containing toner as a major ingredient and carrier. The toner and the carrier may be replenished separately as the replenishment developer 2. The ratio of the carrier in the replenishment developer 2 is preferably 5 to 40 wt %, further preferably 10 to 30 wt %. In addition, below the downstream side of the conveying direction of the second conveying passage 70, a developer recovery tank 90 is disposed and communicates with the second conveying passage 70 via a recovery port 92.

At the bottom of the developer replenishing tank 80, a developer supplying roller is disposed, the driving operation of which is controlled using a controller 100. When the developer supplying roller is driven and rotated, the replenishment developer 2, which is fresh and the amount of which corresponds to the driving time of the roller, flows downward and is supplied to the first conveying passage 68 of the developer tank 66.

In the first conveying passage 68, a first screw 72 serving as a stirring member for conveying the developer-tank-contained developer 3 while stirring the developer is rotatably supported. In the second conveying passage 70, a second screw 74 for conveying the developer-tank-contained developer 3 from the first conveying passage 68 to the developing roller 48 while stirring the developer is rotatably supported. In this case, the upper portions of the partition wall 76 located at both end sections of the first conveying passage 68 and the second conveying passage 70 are cut out, and communicating passages are formed. The developer-tank-contained developer 3 having reached the end section on the downstream side in the conveying direction of the first conveying passage 68 is sent into the second conveying passage 70 via the communicating passage, and the developer-tank-contained developer 3 having reached the end section on the downstream side in the conveying direction of the second conveying passage 70 is sent into the first conveying passage 68 via the communicating passage. As a result, the developer-tank-contained developer 3 is circulated inside the developer stirring and conveying chamber in the direction indicated by the arrows shown in FIG. 2.

Figure 7:
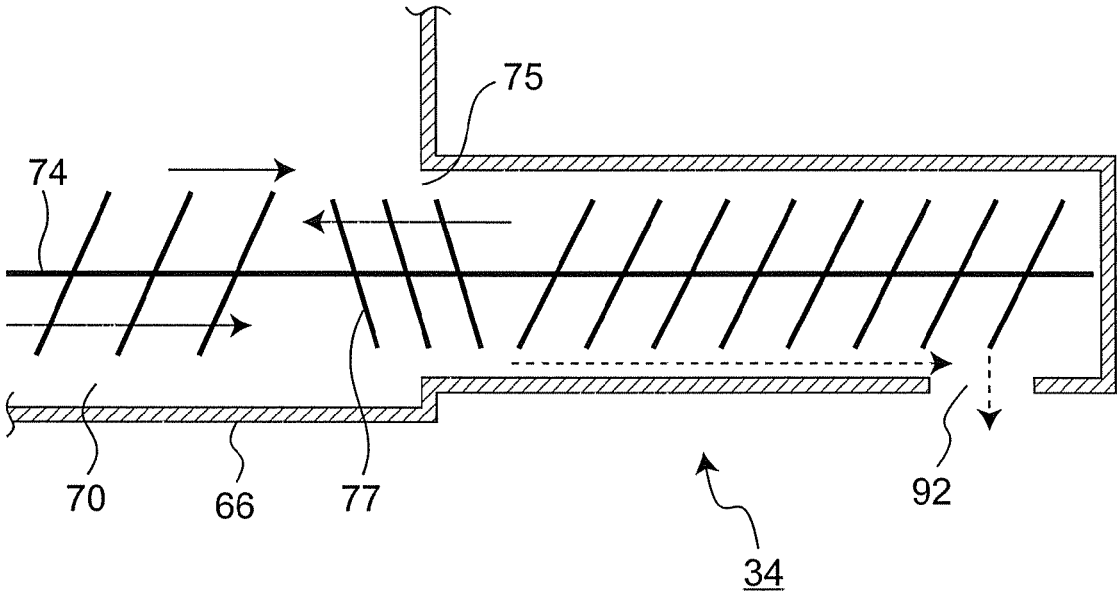
FIG. 7 is a schematic sectional view showing part of the developing device of the image forming apparatus shown in FIG. 1 as seen from the side.

The first screw 72 and the second screw 74 are each a spiral screw in which a spiral vane with a predetermined pitch is secured to a shaft. FIG. 7 is a schematic sectional view showing part of the developing device 34 as seen from the side and corresponding to the right end section shown in FIG. 2. As shown in FIG. 7, the second screw 74 is extended rightward in the figure and further extended above the recovery port 92. At each of the positions corresponding to the communicating passage from the second conveying passage 70 to the first conveying passage 68 and to the downstream side end section of the first conveying passage 68, the second screw 74 has a reverse vane section 77 in which the spiral direction of the spiral screw is opposite to that at the other section. The pitch of the vane of the second screw 74 at the downstream side end section (the right end section in FIG. 2) in the conveying direction is made smaller than that at the other section. As a result, when the second screw 74 is rotated, the level of the developer-tank-contained developer 3 at the downstream side end section (the right end section) in the conveying direction of the second screw 74 becomes higher than that at the other vane section. In other words, a rising of the developer-tank-contained developer 3 is formed at the downstream side end section (the right end section) in the conveying direction of the second screw 74.

Since the developing device 34 employs the so-called trickle system, the developing device has an outlet 75 for allowing an excessive amount of the developer-tank-contained developer 3 to flow out. In other words, the outlet 75 is formed by providing a cutout 75 that is formed by partially cutting out the upper portion of the side wall located at the downstream side end section (the right end section) in the conveying direction of the second conveying passage 70. In a usual state, the developer being conveyed using the second screw 74 is stopped using the reverse vane section 77 and conveyed from the second conveying passage 70 to the first conveying passage 68 as indicated by the solid-line arrows shown in FIGS. 2 and 7. When the developer-tank-contained developer 3 increases inside the developer tank and the developer level inside the developer tank rises, the developer-tank-contained developer 3 climbs over the outlet 75 disposed at the upper portion of the side wall against the damming action of the reverse vane section 77 and overflows to a recovery chamber adjacent thereto. The excessive amount of the developer-tank-contained developer 3 overflowed to the recovery chamber is conveyed to the recovery port 92 in the directions indicated by the broken-line arrows shown in FIG. 7 and recovered (dumped) into the developer recovery tank 90 via the recovery port 92.

In the developer stirring and conveying chamber 67, a toner concentration detecting sensor 78 for detecting the current toner concentration inside the developer stirring and conveying chamber 67 is provided. The toner concentration detecting sensor 78 detects the permeability of the developer-tank-contained developer 3 being conveyed inside the developer stirring and conveying chamber 67 on the basis of the change in the inductance of a coil, for example. The ratio of the toner in the developer-tank-contained developer 3 is obtained on the basis of the permeability detected using the toner concentration detecting sensor 78. For example, when the amount of the carrier contained in the developer-tank-contained developer 3 is small, it is detected that the ratio of the toner is high. On the other hand, when the amount of the carrier contained in the developer-tank-contained developer 3 is large, it is detected that the ratio of the toner is low. In addition, the voltage signal output from the toner concentration detecting sensor 78 is input to the controller 100, a required replenishing amount is calculated on the basis of the detection signal, the developer replenishing roller of the developer replenishing tank 80 is driven, and the predetermined amount of the replenishment developer 2 is replenished into the developer tank 66.

In the developing device 34, when the toner concentration of the circulating developer-tank-contained developer 3 lowers as the printing operation proceeds, the replenishment developer 2 containing toner and a small amount of carrier is replenished from the developer replenishing tank 80. The replenishment developer 2 having been replenished is conveyed along the first conveying passage 68 and the second conveying passage 70 of the above-mentioned developer stirring and conveying chamber 67 while being mixed and stirred with the developer-tank-contained developer 3 already existing therein. Although the toner is basically consumed on the photosensitive member 12, the carrier is accumulated inside the developing device 34, and the charging performance of the carrier lowers gradually. Since a small amount of the carrier that is bulkier than the toner is contained in the replenishment developer 2, as the replenishment developer 2 is replenished, the amount of the developer-tank-contained developer 3 gradually increases inside the developing device 34. Then, the developer-tank-contained developer 3 having increased in volume circulates in the developer stirring and conveying chamber 67. An excessive amount of the developer-tank-contained developer 3 being unable to circulate in the developer stirring and conveying chamber 67 climbs over the reverse vane section 77 and flows out from the outlet 75 provided at the downstream side end section (the right end section) in the conveying direction of the second conveying passage 70 and is recovered in the developer recovery tank 90 via the recovery port 92. A developer discharge detecting sensor 112 is provided in the recovery port 92 or the developer stirring and conveying chamber 67. The developer discharge detecting sensor 112 comprises, for example, a light-emitting device, such as an infrared LED, and a light-receiving device for receiving the light from the light-emitting device. The discharge of the excessive amount of the developer-tank-contained developer 3 is detected when the light-receiving device detects that the light from the light-emitting device is interrupted by the developer.

The replenishing amount of the replenishment developer 2 is determined on the basis of the current toner concentration of the developer-tank-contained developer 3 detected using the toner concentration detecting sensor 78, the image information (dot counter) at the time of image formation and the ratio of the carrier in the replenishment developer 2 inside the developer replenishing tank 80. The ratio of the carrier in the replenishment developer 2 inside the developer replenishing tank 80 is adjusted to the extent that the carrier inside the developing device 34 is suppressed from deteriorating and that the cost is not increased. As the toner replenishing operation proceeds, the carrier is supplied gradually.

Figure 3:
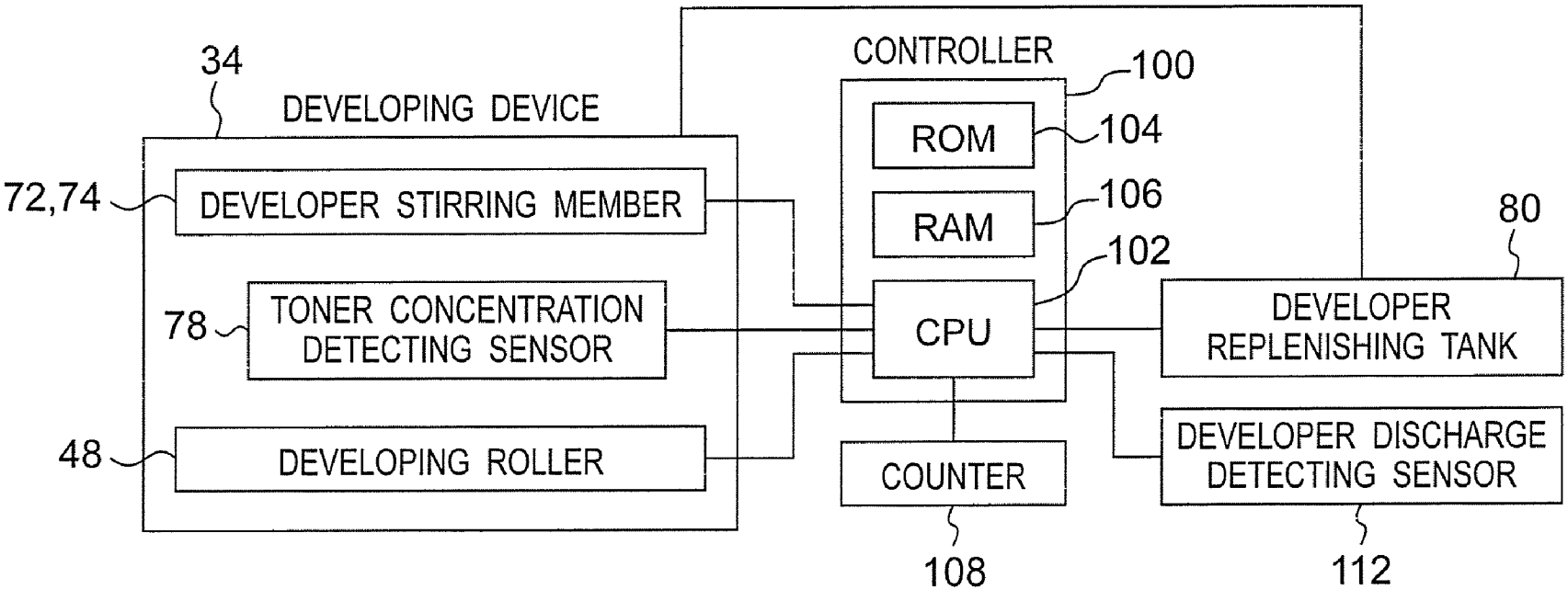
FIG. 3 is a block diagram of the developing device of the image forming apparatus shown in FIG. 2.

FIG. 3 is a control block diagram of the developing device 34 of the image forming apparatus 1.

The controller 100 serving as control unit comprises a CPU (central processing unit) 102, a ROM (read only memory) 104, a RAM (random access memory) 106, etc. The CPU 102 concentratedly controls various operations in the image forming apparatus 1 according to various processing programs and tables stored inside the ROM 104. In the ROM 104, for example, a toner concentration calculation table for carrying out calculation to convert the voltage detected using the toner concentration detecting sensor 78 into the current toner concentration of the developer-tank-contained developer 3 and a developer replenishing table for calculating the amount of the developer to be replenished on the basis of the difference between the current toner concentration of the developer-tank-contained developer 3 and a corrected reference toner concentration are stored.

Furthermore, in the ROM 104, a predetermined correction value that is used to calculate the corrected reference toner concentration that is calculated according to the current toner concentration minus the correction value and a predetermined allowable value for the current toner concentration with respect to the reference toner concentration are stored. The RAM 106 provides a work area in which various programs to be executed by the controller 100 and data for the programs are temporarily stored.

Although the correction value can be set at various values, such as 0.25 wt % and 0.75 wt %, depending on the current toner concentration inside the developer tank, the toner concentration of the replenishment developer 2, etc., the correction value is preferably 0.5 wt %. The correction value is set at a value higher than the fluctuation value of the toner concentration due to the ordinary replenishment control so that shifting to a replenishment control correction mode is prevented by selecting NO at the judgment step, step S30 in FIG. 4 described later, when the toner concentration rises slightly by virtue of the ordinary replenishment of the replenishment developer.

The allowable value is used when a judgment is made as to whether the corrected reference toner concentration changing/replenishing operation is repeated or not. If the allowable value is set smaller than the correction value, the current toner concentration becomes lower than the reference toner concentration after a series of restoration operation is completed; hence, the allowable value is set at the correction value or larger.

The developing device 34, the developer replenishing tank 80, the developer discharge detecting sensor 112 and a counter 108 are connected to the CPU 102.

The operations of the developer stirring members 72 and 74, the toner concentration detecting sensor 78 and the developing roller 48 constituting the developing device 34, the replenishment control operation for the replenishment developer 2 and the correction operation of correcting the reference toner concentration to the corrected reference toner concentration are controlled using the CPU 102 of the controller 100. In addition, the current toner concentration of the developer-tank-contained developer 3 detected using the toner concentration detecting sensor 78, image information at the time of image formation, the corrected reference toner concentration, the calculated replenishment amount of the replenishment developer 2, the ratio of the carrier in the replenishment developer 2 inside the developer replenishing tank 80, etc. are temporarily stored in the RAM 106.

[Developer]

The two-component developer contains toner and carrier for charging the toner. In the present invention, the known toner that has been used generally and conventionally can be used for the image forming apparatus 1. The particle diameter of the toner is, for example, approximately 3 to 15 μm. It is also possible to use toner containing a coloring agent in a binder resin, toner containing a charge control agent and a releasing agent, and toner holding additives on the surface.

The toner is produced using known methods, such as the grinding method, the emulsion polymerization method and the suspension polymerization method.

Examples of the binder resin being used for the toner include styrene resins (homopolymers or copolymers containing styrene or styrene substitutes), polyester resins, epoxy resins, polyvinyl chloride resins, phenol resins, polyethylene resins, polypropylene resins, polyurethane resins, silicone resins or any appropriate combinations of these resins, although not restricted to these. The softening temperature of the binder resin is preferably in the range of approximately 80 to 160° C., and the glass transition temperature thereof is preferably in the range of approximately 50 to 75° C.

As the coloring agent, it is possible to use known materials, such as carbon black, aniline black, activated charcoal, magnetite, benzine yellow, permanent yellow, naphthol yellow, phthalocyanine blue, fast sky blue, ultramarine blue, rose bengal and lake red. In general, the additive amount of the coloring agent is preferably 2 to 20 parts by weight per 100 parts by weight of the binder resin.

The materials conventionally known as charge control agents can be used as the charging control agent. More specifically, for the toner that is positively charged, it is possible to use materials, such as nigrosin dyes, quaternary ammonium salt compounds, triphenylmethane compounds, imidazole compounds and polyamine resins, as the charge control agent. For the toner that is negatively charged, it is possible to use materials, such as azo dyes containing metals such as Cr, Co, Al and Fe, salicylic acid metal compounds, alkyl salicylic acid metal compounds and calixarene compounds, as the charge control agent. It is desirable that the charge control agent is used in the ratio of 0.1 to 10 parts by weight per 100 parts by weight of the binder resin.

The materials conventionally known and used as releasing agents can be used as the releasing agent. As the material of the releasing agent, it is possible to use materials, such as polyethylene, polypropylene, carnauba wax, sasol wax or any appropriate combinations of these. It is desirable that the releasing agent is used in the ratio of 0.1 to 10 parts by weight per 100 parts by weight of the binder resin.

Furthermore, it may be possible to add a fluidizer for accelerating the fluidization of the developer. As the fluidizer, it is possible to use inorganic particles, such as silica, titanium oxide and aluminum oxide, and resin particles, such as acrylic resins, styrene resins, silicone resins and fluororesins. It is particularly desirable to use materials hydrophobized using a silane coupling agent, a titanium coupling agent, silicone oil, etc. It is desirable that the fluidizer is added in the ratio of 0.1 to 5 parts by weight per 100 parts by weight of the toner. It is desirable that the number average primary particle diameters of these additives are in the range of 9 to 100 nm.

As the carrier, the known carriers used conventionally and generally can be used. Either the binder-type carrier or the coated-type carrier may be used. It is desirable that the diameter of the carrier particles is in the range of approximately 15 to 100 μm, although not restricted to this range.

The binder-type carrier is that obtained by dispersing magnetic particles in a binder resin and it is possible to use carrier having positively or negatively charged particles or a coating layer on its surface. The charging characteristics, such as polarity, of the binder-type carrier can be controlled depending on the material of the binder resin, electrostatic charging particles and the kind of the surface coating layer.

Examples of the binder resin being used for the binder-type carrier include thermoplastic resins, such as vinyl resins typified by polystyrene resins, polyester resins, nylon resins and polyolefin resins, and thermosetting resins, such as phenol resins.

As the magnetic particles of the binder-type carrier, it is possible to use spinel ferrites, such as magnetite and gamma ferric oxide; spinel ferrites containing one or more kinds of nonferrous metals (such as Mn, Ni, Mg and Cu); magnetoplumbite ferrites, such as barium ferrite; and iron or alloy particles having oxide layers on the surfaces. The shape of the carrier may be particulate, spherical or needle-like. In particular, when high magnetization is required, it is desirable to use iron-based ferromagnetic particles. In consideration of chemical stability, it is desirable to use ferromagnetic particles of spinel ferrites, such as magnetite and gamma ferric oxide, or magnetoplumbite ferrites, such as barium ferrite. It is possible to obtain magnetic resin carrier having the desired magnetization by appropriately selecting the kind and content of the ferromagnetic particles. It is appropriate to add 50 to 90 wt % of the magnetic particles to the magnetic resin carrier.

As the surface coating material of the binder-type carrier, it is possible to use silicone resins, acrylic resins, epoxy resins, fluororesins, etc. The charging capability of the carrier can be enhanced by coating the surface of the carrier with this kind of resin and by thermosetting the resin.

The fixation of electrostatic charging particles or electrically conductive particles to the surface of the binder-type carrier is carried out according to, for example, a method in which the magnetic resin carrier is uniformly mixed with the particles, the particles are attached to the surface of the magnetic resin carrier, and then mechanical and thermal impact forces are applied to the particles to put the particles into the magnetic resin carrier. In this case, the particles are not completely embedded into the magnetic resin carrier but fixed such that parts thereof protrude from the surface of the magnetic resin carrier. As the electrostatic charging particles, organic or inorganic insulating materials are used. More specifically, as organic insulating materials, organic insulating particles, such as polystyrene, styrene copolymers, acrylic resins, various acrylic copolymers, nylon, polyethylene, polypropylene, fluororesins and cross-linked materials of these are available. The charging capability and the charging polarity thereof can be adjusted so as to be suited for the material of the electrostatic charging particles, polymerization catalyst, surface treatment, etc. As the inorganic insulating material, negatively charged inorganic particles, such as silica and titanium dioxide, and positively charged inorganic particles, such as strontium titanate and alumina, are used.

The coated-type carrier is carrier obtained by coating carrier core particles made of a magnetic substance with a resin, and electrostatic charging particles charged positively or negatively can be fixed to the surface of the carrier, as in the case of the binder-type carrier. The charging characteristics, such as polarity, of the coated-type carrier can be adjusted by selecting the kind of the surface coating layer and the electrostatic charging particles. As the coating resin, it is possible to use resins similar to the binder resins for the binder-type carrier.

The mixture ratio of the toner and the carrier of the developer-tank-contained developer 3 is adjusted such that a desired toner charging amount is obtained. The ratio of the toner in the developer-tank-contained developer 3 is preferably 3 to 20 wt % and further preferably 4 to 15 wt % with respect to the total amount of the toner and the carrier. In addition, the replenishment developer 2 stored in the developer replenishing tank 80 contains toner and a small amount of carrier, and the ratio of the carrier in the replenishment developer 2 is preferably 1 to 50 wt % and further preferably 5 to 30 wt %.

The operation of the developing device 34 configured as described above will be described.

At the time of image formation, the sleeve 48*b* of the developing roller 48 is rotated in the direction indicated by the arrow (counterclockwise) on the basis of the driving of the motor (not shown). By the rotation of the first screw 72 and the rotation of the second screw 74, the developer-tank-contained developer 3 existing in the developer stirring and conveying chamber 67 is stirred while being circulated and conveyed between the first conveying passage 68 and the second conveying passage 70. As a result, the toner and the carrier contained in the developer make friction contact and are charged to have polarities opposite to each other. In this embodiment, it is assumed that the carrier is positively charged and that the toner is negatively charged. However, the charging characteristics of the toner and the carrier being used for the present invention are not limited to these combinations. The external size of the carrier is considerably larger than that of the toner. For this reason, the negatively charged toner is attached around the circumference of the positively charged carrier mainly on the basis of the electric attraction force exerted therebetween.

The developer-tank-contained developer 3 charged as described above is supplied to the developing roller 48 in the process of being conveyed to the second conveying passage 70 using the second screw 74. The developer is held on the surface of the sleeve 48*b* by the magnetic force of the magnet 48*a* inside the developing roller 48 and moved while being rotated counterclockwise together with the sleeve 48*b*, the throughput thereof is regulated using the regulating plate 62 disposed so as to be opposed to the developing roller 48, and then the developer is conveyed to the developing area opposed to the photosensitive member 12. Furthermore, in the developing area, chains of particles (magnetic brush) are formed by the magnetic force of the main magnet pole N1 of the magnet 48*a*. In the developing area, by the force of the electric field (electric field of AC superimposed on DC) that is formed between the electrostatic latent image on the photosensitive member 12 and the developing roller 48 to which a developing bias is applied and exerted to the toner, the toner is moved to the electrostatic latent image on the photosensitive member 12, and the electrostatic latent image is developed into a visible image. The developer, the toner of which is consumed in the developing area, is conveyed toward the developer tank 66, detached from the surface of the developing roller 48 by the repulsive magnetic field between the poles N3 and N2 of the magnet 48*a* disposed so as to be opposed to the second conveying passage 70 of the developer tank 66, and then recovered into the developer tank 66. The recovered developer is mixed with the developer-tank-contained developer 3 that is being conveyed to the second conveying passage 70.

When the toner contained in the developer-tank-contained developer 3 is consumed by the image formation described above, it is desirable that the amount of the toner corresponding to the consumed amount is replenished to the developer-tank-contained developer 3. For this purpose, the developing device 34 is equipped with the toner concentration detecting sensor 78 for measuring the ratio of the toner in the developer-tank-contained developer 3 existing in the developer stirring and conveying chamber 67. Furthermore, the developer replenishing tank 80 is provided above the first conveying passage 68.

In the image formation according to the present invention, ordinary image formation is carried out in which paper output is performed after development.

Next, the operation of the developing device 34 according to the first embodiment will be described referring to FIGS. 4 and 5.

Figure 4:
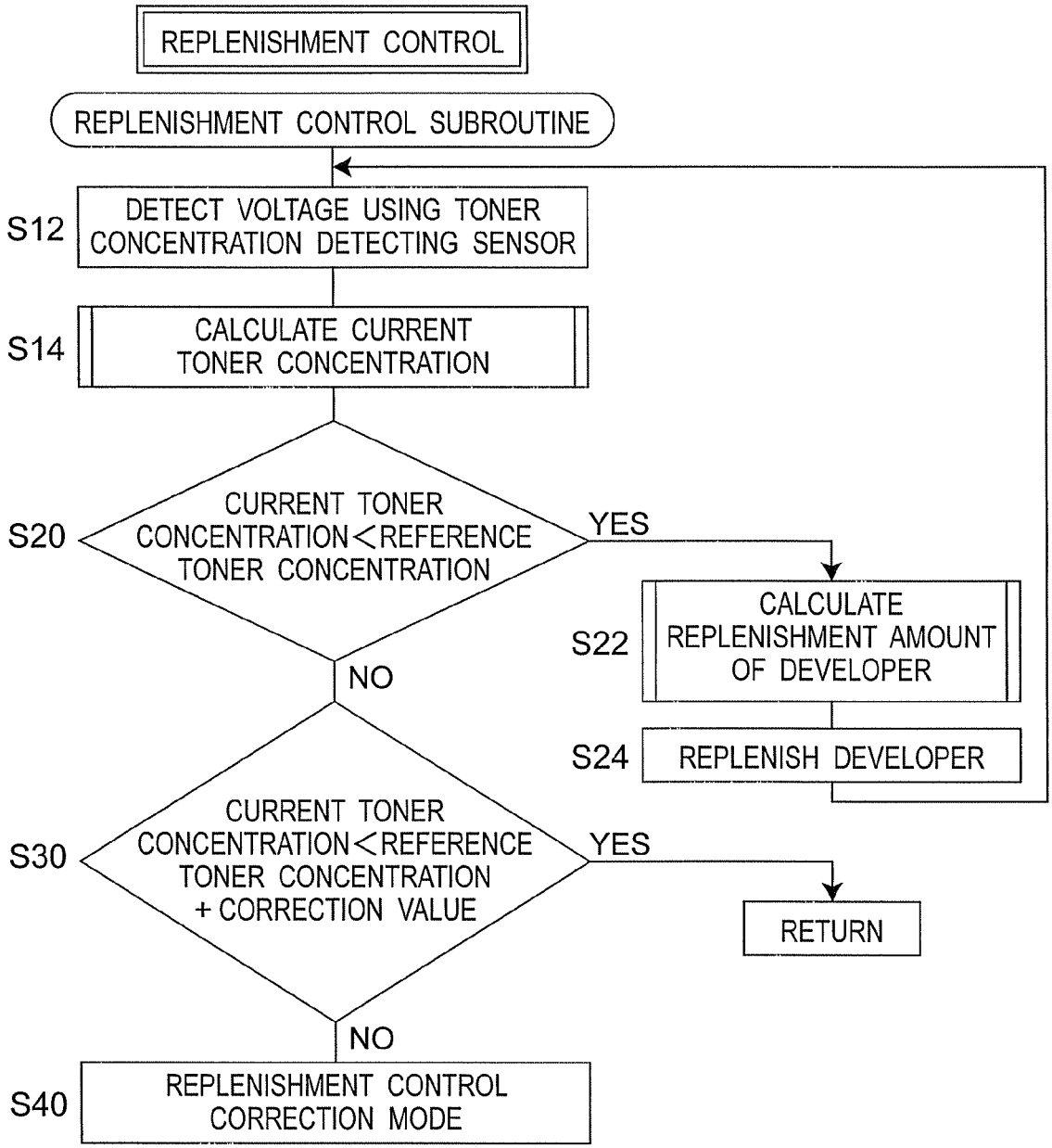
FIG. 4 is a flowchart of a subroutine regarding the replenishment operation of the developing device according to the first embodiment of the present invention.

FIG. 4 is a main flowchart showing the replenishment control for the developing device 34 according to the first embodiment of the present invention. FIG. 5 is a flowchart in a first replenishment control correction mode according to the first embodiment. Although the description is given while the following specific numeric values are used to facilitate the understanding of the first replenishment control correction mode according to the first embodiment, the numeric values are only examples, and this embodiment is not restricted by the numeric values.

The reference toner concentration of the developer-tank-contained developer 3 stored in the trickle developing device 34 is 7 wt %, and its storage amount is approximately 250 g. The current toner concentration in the initial state is assumed to be 9 wt %. The correction value that is used to calculate the corrected reference toner concentration is 0.5 wt %. Furthermore, the allowable value for the current toner concentration with respect to the reference toner concentration is 0.5 wt %. The ratio of the carrier in the replenishment developer 2 is 20 wt %. The predetermined replenishment amount of the replenishment developer 2 is approximately 25 g, corresponding to approximately 20 g when converted into the amount of the toner, and also corresponding to approximately 5 g when converted into the amount of the carrier.

FIG. 4 shows a subroutine regarding the replenishment control for the developing device 34 in the entire control (main routine), not shown. At step S12, a voltage signal regarding the current toner concentration of the developer-tank-contained developer 3 existing in the developer stirring and conveying chamber 67 is output from the toner concentration detecting sensor 78. At step S14, the output voltage signal is converted by calculation into the value of the current toner concentration using the controller 100. At step S20, a judgment is made as to whether the current toner concentration is lower than the reference toner concentration (7 wt %). When the current toner concentration is judged to be lower than the reference toner concentration (7 wt %), at step S22, the replenishment amount of the replenishment developer 2 is calculated on the basis of the current toner concentration detected using the toner concentration detecting sensor 78, the image information (dot counter) at the time of image formation and the ratio of the carrier in the replenishment developer 2 inside the developer replenishing tank 80. Furthermore, at step S24, the predetermined amount of the replenishment developer 2 is replenished, and the process returns to step S12 for toner concentration detection.

When the current toner concentration is judged to be equal to or higher than the reference toner concentration at step S20, a judgment is made at step S30 as to whether the current toner concentration is lower than the reference toner concentration (7 wt %)+the correction value (0.5 wt %)=7.5 wt %. When the current toner concentration is judged to be lower than 7.5 wt %, the subroutine ends, and the process returns to the main routine. When the current toner concentration is judged to be equal to or higher than the reference toner concentration (7 wt %)+the correction value (0.5 wt %)=7.5 wt % due to the measurement accuracy of the toner concentration detecting sensor 78, the filling state of the developer-tank-contained developer 3 around the toner concentration detecting sensor 78 and the changes in the ambient environment of the image forming apparatus, for example, when the current toner concentration is judged to be 9 wt %, the process shifts to the first replenishment control correction mode at step S40.

Figure 5:
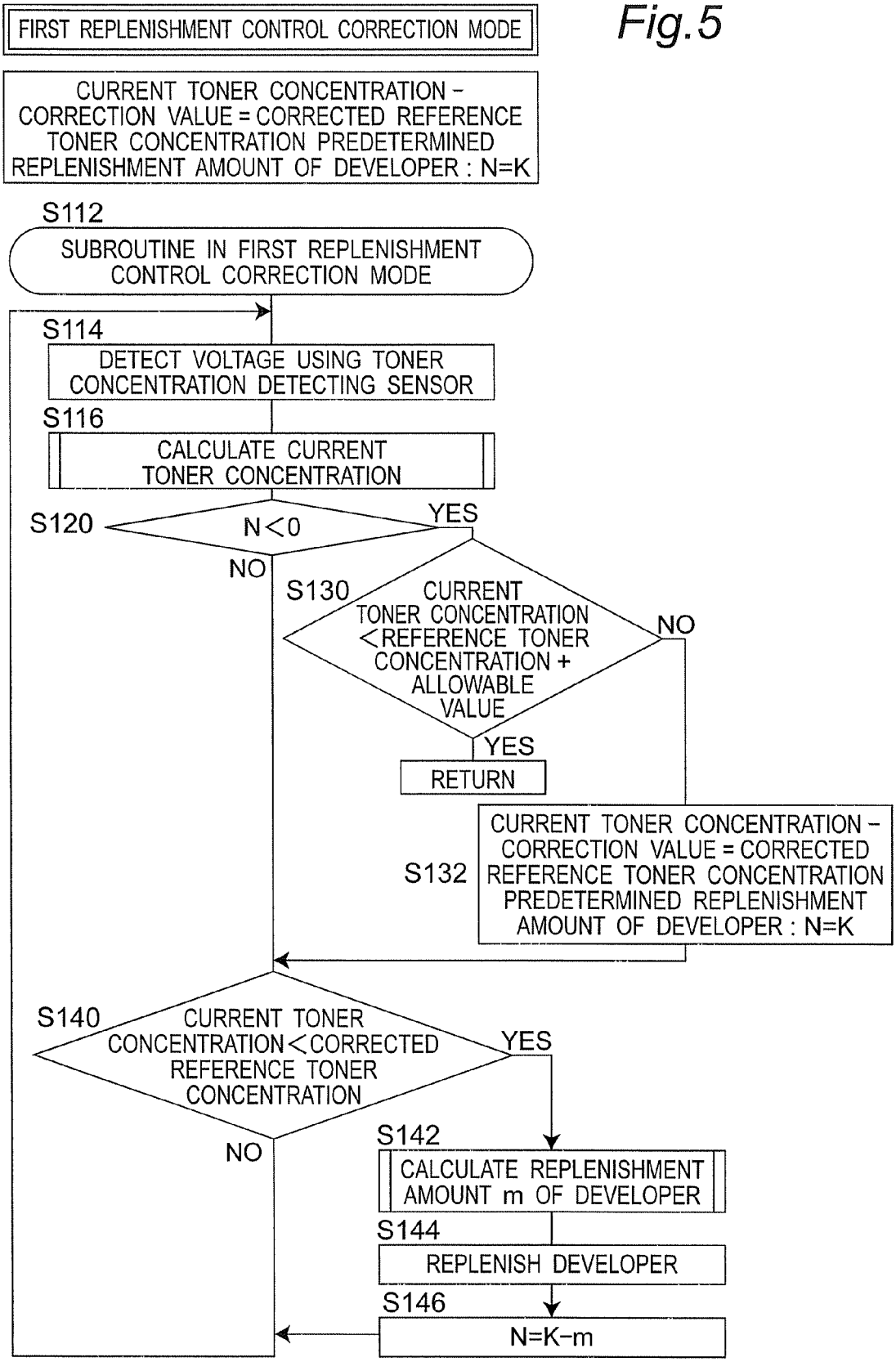
FIG. 5 is a flowchart of a subroutine regarding a first replenishment control correction mode according to the first embodiment.

FIG. 5 shows a subroutine regarding the first replenishment control correction mode of the subroutine regarding the replenishment control for the developing device 34, shown in FIG. 4. While this subroutine is executed, ordinary image formation is carried out repeatedly.

First, as an initial corrected reference toner concentration, for example, 8.5 wt % is set according to the calculation formula of the current toner concentration (9 wt % as an initial value)−the correction value (0.5 wt %). Furthermore, an initial value K=25 g is set as a predetermined replenishment amount N, that is, an amount of how many grams of the replenishment developer 2 should be replenished.

At step S112, the subroutine regarding the first replenishment control correction mode starts. At step S114, a voltage signal regarding the current toner concentration of the developer-tank-contained developer 3 existing in the developer stirring and conveying chamber 67 is output from the toner concentration detecting sensor 78. At step S116, the output voltage signal is converted by calculation into the value of the current toner concentration using the controller 100.

At step S120, a judgment is made as to whether the predetermined replenishment amount N (25 g) is smaller than 0. Since the predetermined replenishment amount N is set at the initial value of 25 g, NO is selected at step S120.

At step S140, a judgment is made as to whether the current toner concentration of the developer-tank-contained developer 3 is lower than the first corrected reference toner concentration (8.5 wt %). Since the current toner concentration in the initial state is 9 wt % and the first corrected reference toner concentration is 8.5 wt %, NO is selected at step S140. When NO is selected at step S140, the process returns to step S114 for the voltage detection regarding the current toner concentration, and the routine from step S114 to step S140 described above is carried out repeatedly; during this time, ordinary image formation (image formation in which paper output is performed after development and the toner is consumed) is carried out repeatedly. Since the ordinary image formation is carrying out repeatedly, the current toner concentration of the developer-tank-contained developer 3 lowers gradually.

When the current toner concentration of the developer-tank-contained developer 3 lowers and becomes lower than the first corrected reference toner concentration (8.5 wt %), YES is selected at step S140. When YES is selected at step S140, the replenishment amount (m g) of the replenishment developer 2 is calculated at step S142 on the basis of the current toner concentration detected using the toner concentration detecting sensor 78, the image information (dot counter) at the time of image formation and the ratio of the carrier in the replenishment developer 2 inside the developer replenishing tank 80. Furthermore, at step S144, the replenishment amount (m g) of the replenishment developer 2 is replenished, and the developer level inside the developer tank rises depending on the replenishment amount. Then, at step S146, the predetermined replenishment amount N is substituted by (K−m)g.

Since the toner concentration of the developer-tank-contained developer 3 rises temporarily by the replenishment of the replenishment developer 2 and becomes higher than the first corrected reference toner concentration (8.5 wt %), NO is selected at step S140, and the process returns to step S114. Then, the routine from step S114 to step S140 is repeated. While the routine is carried out repeatedly, ordinary image formation (image formation in which paper output is performed after development and the toner is consumed) is carried out repeatedly. Since the ordinary image formation is carrying out repeatedly, the current toner concentration of the developer-tank-contained developer 3 lowers gradually and becomes equal to the first corrected reference toner concentration (8.5 wt %).

When the current toner concentration becomes lower than the first corrected reference toner concentration (8.5 wt %), YES is selected at step S140. As a result, at step S142, the replenishment amount (m g) of the replenishment developer 2 is calculated on the basis of the current toner concentration detected using the toner concentration detecting sensor 78, the image information (dot counter) at the time of image formation and the ratio of the carrier in the replenishment developer 2 inside the developer replenishing tank 80. Furthermore, at step S144, the replenishment amount (m g) of the replenishment developer 2 is replenished, and the developer level inside the developer tank rises depending on the replenishment amount. Then, at step S146, the predetermined replenishment amount N is substituted by (K−m)g.

The current toner concentration of the developer-tank-contained developer 3 is maintained at approximately 8.5 wt % by repeating the routine from step S114 to step S140 described above. In addition, since approximately 25 g of the replenishment developer 2 is replenished, the developer level inside the developer tank is restored. When the replenishment of 25 g or more of the replenishment developer 2 is completed, at step S120, the predetermined replenishment amount N (25 g) is judged to be smaller than 0, and YES is selected at step S120.

At step S130, a judgment is made as to whether the current toner concentration of the developer-tank-contained developer 3 is lower than the reference toner concentration (7 wt %)+the allowable value (0.5 wt %)=7.5 wt %. Since the current toner concentration of the developer-tank-contained developer 3 is controlled so as to be equal to the first corrected reference toner concentration (8.5 wt %) using the above-mentioned routine, NO is selected. At step S132, the corrected reference toner concentration having been set at 8.5 wt % is changed to a second corrected reference toner concentration, that is, the current toner concentration (8.5 wt %)−the correction value (0.5 wt %)=8.0 wt %. Furthermore, an initial value of 25 g is set as the predetermined replenishment amount N.

Next, at step S140, a judgment is made as to whether the current toner concentration of the developer-tank-contained developer 3 is lower than the corrected reference toner concentration; however, since the current toner concentration (8.5 wt %) of the developer-tank-contained developer 3 is higher than the second corrected reference toner concentration (8.0 wt %), NO is selected.

Since NO is selected at step S140, the process returns to step S114 for the voltage detection regarding the current toner concentration, and the routine from step S114 to step S140 described above is carried out repeatedly; during this time, ordinary image formation (image formation in which paper output is performed after development and the toner is consumed) is carried out repeatedly. Since the ordinary image formation is carrying out repeatedly, the current toner concentration of the developer-tank-contained developer 3 lowers gradually and becomes equal to the second corrected reference toner concentration (8.0 wt %).

When the current toner concentration becomes lower than the second corrected reference toner concentration (8.0 wt %), at step S140, YES is selected. As a result, at step S142, the replenishment amount (m g) of the replenishment developer 2 is calculated on the basis of the current toner concentration detected using the toner concentration detecting sensor 78, the image information (dot counter) at the time of image formation and the ratio of the carrier in the replenishment developer 2 inside the developer replenishing tank 80. Furthermore, at step S144, the replenishment amount (m g) of the predetermined replenishment developer 2 is replenished, and the developer level inside the developer tank rises depending on the replenishment amount. Then, at step S146, the predetermined replenishment amount N is substituted by (K−m) g.

The current toner concentration of the developer-tank-contained developer 3 is maintained at approximately 8.0 wt % by repeating the above-mentioned routine. In addition, since approximately 25 g of the replenishment developer 2 is replenished, the developer level inside the developer tank is restored. When the replenishment of 25 g or more of the replenishment developer 2 is completed, at step S120, the predetermined replenishment amount N (25 g) is judged to be smaller than 0, and YES is selected at step S120.

At step S130, a judgment is made as to whether the current toner concentration of the developer-tank-contained developer 3 is lower than the reference toner concentration (7 wt %)+the allowable value (0.5 wt %)=7.5 wt %. Since the current toner concentration of the developer-tank-contained developer 3 is controlled so as to be equal to the second corrected reference toner concentration (8.0 wt %) using the above-mentioned routine, NO is selected. At step S132, the corrected reference toner concentration having been set at 8.0 wt % is changed to a third corrected reference toner concentration, that is, the current toner concentration (8.0 wt %)−the correction value (0.5 wt %)=7.5 wt %. Furthermore, an initial value of 25 g is set as the predetermined replenishment amount N.

The current toner concentration of the developer-tank-contained developer 3 gradually becomes close to the reference toner concentration (7.0 wt %) by repeating the above-mentioned series of operations. In the end, at step S130, when the current toner concentration of the developer-tank-contained developer 3 becomes 7.3 wt %, for example, and is judged to be lower than the reference toner concentration (7 wt %)+the allowable value (0.5 wt %)=7.5 wt %, the subroutine regarding the first replenishment control correction mode ends, and the process returns to the subroutine regarding the replenishment control for the developing device 34, shown in FIG. 4.

The current toner concentration of the developer-tank-contained developer 3 gradually became close to the reference toner concentration (7 wt %) by carrying out the above-mentioned first replenishment control correction mode, and the volume level of the developer-tank-contained developer 3 inside the developer tank 66 was restored. Furthermore, as the result of general image formation carried out using the image forming apparatus 1 having the first replenishment control correction mode described above, image loss due to screw irregularity or the like did not occur, and the effect of the first replenishment control correction mode has been verified.

Next, the operation of the developing device 34 according to a second embodiment will be described referring to FIG. 6.

Figure 6:
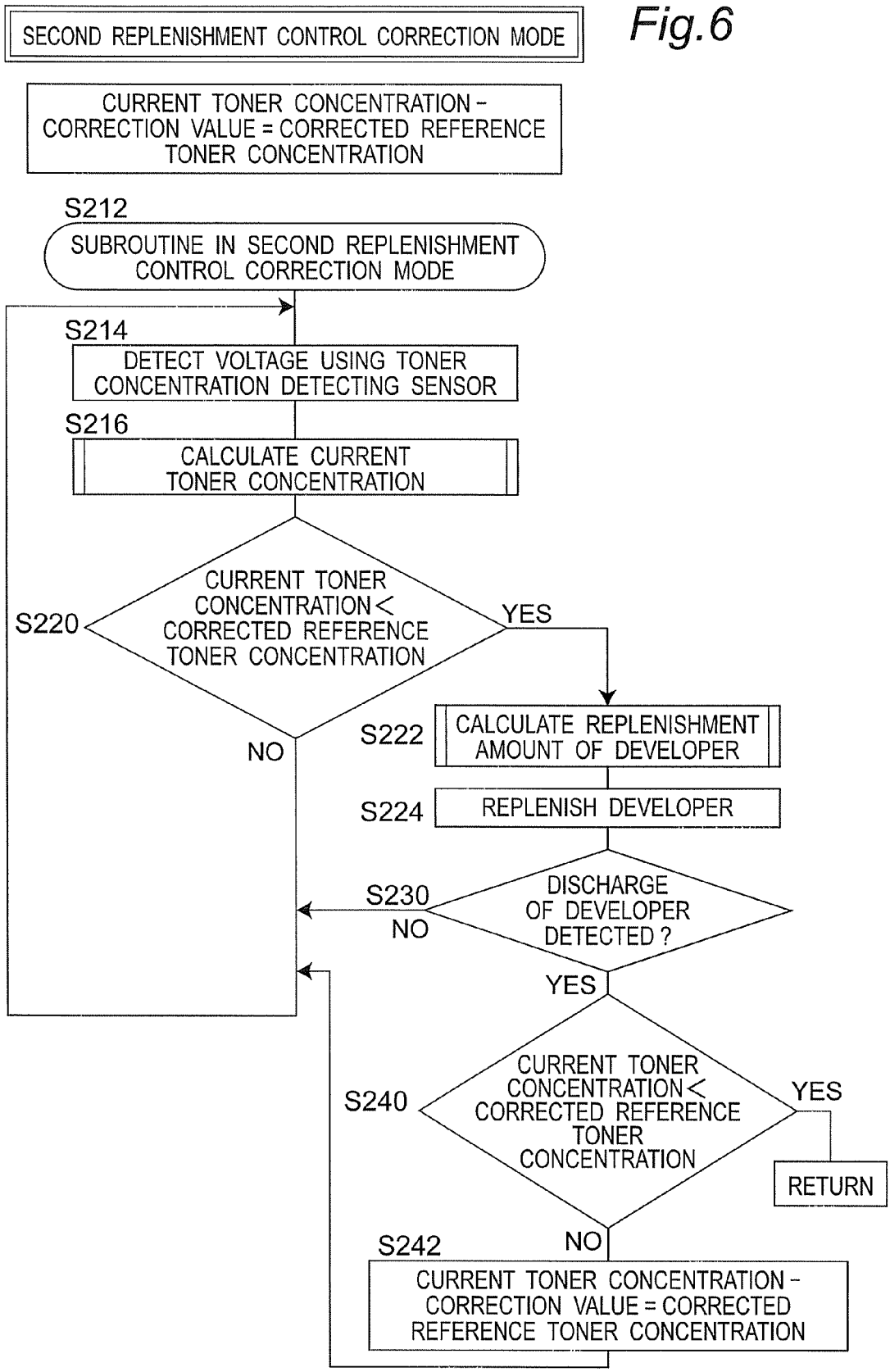
FIG. 6 is a flowchart of a subroutine regarding a second replenishment control correction mode according to a second embodiment.

FIG. 6 is a flowchart of a subroutine regarding a second replenishment control correction mode according to the second embodiment. Although the description is given while the following specific numeric values are used to facilitate the understanding of the second replenishment control correction mode according to the second embodiment, the numeric values are only examples, and this embodiment is not restricted by the numeric values.

The reference toner concentration of the developer-tank-contained developer 3 stored in the trickle developing device 34 is 7 wt %, and its storage amount is approximately 250 g. The current toner concentration in the initial state is assumed to be 9 wt %. The correction value that is used to calculate the corrected reference toner concentration is 0.5 wt %. Furthermore, the allowable value for the current toner concentration with respect to the reference toner concentration is 0.5 wt %.

In the second embodiment, since the subroutine regarding the replenishment control for the developing device 34 is the same as that for the above-mentioned first embodiment, the description thereof is omitted, and only the subroutine regarding the second replenishment control correction mode, different from that of the first embodiment, will be described.

FIG. 6 shows a subroutine regarding the second replenishment control correction mode of the subroutine regarding the replenishment control for the developing device 34, shown in FIG. 4. While this subroutine is executed, ordinary image formation is carried out repeatedly.

First, as an initial corrected reference toner concentration, for example, 8.5 wt % is set according to the calculation formula of the current toner concentration (9 wt % as an initial value)−the correction value (0.5 wt %).

At step S212, the subroutine regarding the second replenishment control correction mode starts. At step S214, a voltage signal regarding the current toner concentration of the developer-tank-contained developer 3 existing in the developer stirring and conveying chamber 67 is output from the toner concentration detecting sensor 78. At step S216, the output voltage signal is converted by calculation into the value of the current toner concentration using the controller 100.

At step S220, a judgment is made as to whether the current toner concentration of the developer-tank-contained developer 3 is lower than the first corrected reference toner concentration (8.5 wt %). Since the current toner concentration in the initial state is 9 wt % and the first corrected reference toner concentration is 8.5 wt %, NO is selected at step S220. When NO is selected at step S220, the process returns to step S214 for the voltage detection regarding the current toner concentration, and the routine from step S214 to step S220 described above is carried out repeatedly; during this time, ordinary image formation (image formation in which paper output is performed after development and the toner is consumed) is carried out repeatedly. Since the ordinary image formation is carrying out repeatedly, the current toner concentration of the developer-tank-contained developer 3 lowers gradually.

When the current toner concentration of the developer-tank-contained developer 3 lowers and becomes lower than the first corrected reference toner concentration (8.5 wt %), YES is selected at step S220. When YES is selected at step S220, the replenishment amount of the replenishment developer 2 is calculated at step S222 on the basis of the current toner concentration detected using the toner concentration detecting sensor 78, the image information (dot counter) at the time of image formation and the ratio of the carrier in the replenishment developer 2 inside the developer replenishing tank 80. Furthermore, at step S224, the predetermined replenishment amount of the replenishment developer 2 is replenished, and the developer level inside the developer tank rises depending on the replenishment amount. Then, at step S230, a judgment is made as to whether the discharge of the developer-tank-contained developer 3 is detected using the developer discharge detecting sensor 112.

When the discharge of the developer-tank-contained developer 3 is not detected and NO is selected at step S230, the process returns to step S214. Then, the routine from step S214 to step S230 described above is repeated. While the routine is carried out repeatedly, ordinary image formation (image formation in which paper output is performed after development and the toner is consumed) is carried out repeatedly. Since the ordinary image formation is carrying out repeatedly, the current toner concentration of the developer-tank-contained developer 3 lowers gradually and becomes equal to the first corrected reference toner concentration (8.5 wt %). At the same time, the replenishment developer 2 is replenished until the discharge of the developer-tank-contained developer 3 is detected using the developer discharge detecting sensor 112. When the replenishment of the replenishment developer 2 is completed, the developer level inside the developer tank is restored to the predetermined level, and at step S230, the discharge of the developer-tank-contained developer 3 is judged to have been detected, and YES is selected at step S230.

At step S240, a judgment is made as to whether the current toner concentration of the developer-tank-contained developer 3 is lower than the reference toner concentration (7 wt %)+the allowable value (0.5 wt %)=7.5 wt %. Since the current toner concentration of the developer-tank-contained developer 3 is controlled so as to be equal to the first corrected reference toner concentration (8.5 wt %) using the above-mentioned routine, NO is selected. At step S242, the corrected reference toner concentration having been set at 8.5 wt % is changed to the second corrected reference toner concentration, that is, the current toner concentration (8.5 wt %)−the correction value (0.5 wt %)=8.0 wt %.

Next, the process returns to step S214 for the voltage detection regarding the current toner concentration, and the routine from step S214 to step S230 described above is carried out repeatedly; during this time, ordinary image formation (image formation in which paper output is performed after development and the toner is consumed) is carried out repeatedly. Since the ordinary image formation is carrying out repeatedly, the current toner concentration of the developer-tank-contained developer 3 lowers gradually and becomes equal to the second corrected reference toner concentration (8.0 wt %). At the same time, the replenishment developer 2 is replenished until the discharge of the developer-tank-contained developer 3 is detected using the developer discharge detecting sensor 112. When the replenishment of the replenishment developer 2 is completed, the developer level inside the developer tank is restored to the predetermined level, and at step S230, the discharge of the developer-tank-contained developer 3 is judged to have been detected, and YES is selected at step S230.

At step S240, a judgment is made as to whether the current toner concentration of the developer-tank-contained developer 3 is lower than the reference toner concentration (7 wt %)+the allowable value (0.5 wt %)=7.5 wt %. Since the current toner concentration of the developer-tank-contained developer 3 is controlled so as to be equal to the second corrected reference toner concentration (8.0 wt %) using the above-mentioned routine, NO is selected. At step S242, the corrected reference toner concentration having been set at 8.0 wt % is changed to the third corrected reference toner concentration, that is, the current toner concentration (8.0 wt %)−the correction value (0.5 wt %)=7.5 wt %.

The current toner concentration of the developer-tank-contained developer 3 gradually becomes close to the reference toner concentration (7.0 wt %) by repeating the above-mentioned series of operations. In the end, at step S240, when the current toner concentration of the developer-tank-contained developer 3 becomes 7.3 wt %, for example, and is judged to be lower than the reference toner concentration (7 wt %)+the allowable value (0.5 wt %)=7.5 wt %, the subroutine regarding the second replenishment control correction mode ends, and the process returns to the subroutine regarding the replenishment control for the developing device 34, shown in FIG. 4.

The current toner concentration of the developer-tank-contained developer 3 gradually became close to the reference toner concentration (7 wt %) by carrying out the above-mentioned second replenishment control correction mode, and the volume level of the developer-tank-contained developer 3 inside the developer tank 66 was restored. Furthermore, as the result of general image formation carried out using the image forming apparatus 1 having the second replenishment control correction mode described above, image loss due to screw irregularity or the like did not occur, and the effect of the second replenishment control correction mode has been verified.

Although the description is given using specific numeric values in the above-mentioned respective embodiments, the present invention is not restricted by the numeric values but can be modified variously without departing from the scope defined in the appended claims and equivalents thereof.

The present invention is characterized in that the corrected reference toner concentration is gradually corrected and returned to the original reference toner concentration. In the above-mentioned embodiments, each time the predetermined amounts of the toner and carrier are replenished into the developer tank, or each time the developer discharge detecting sensor detects the discharge of the developer-tank-contained developer, the corrected reference toner concentration is corrected gradually; however, the correction can also be made with the passage of time. In an embodiment in which the corrected reference toner concentration is corrected with the passage of time, the corrected reference toner concentration can be corrected gradually and continuously with the passage of time or can be corrected stepwise with the passage of time. Furthermore, since there is a correlation between the consumed amount of the developer and the number of image formation operations, the corrected reference toner concentration can also be corrected gradually depending on a predetermined number of image formation operations.

What is claimed is:

1. A developing device having stirring members for stirring a developer-tank-contained developer containing toner and carrier inside a developer tank while conveying said developer and a developer holder disposed adjacent to said stirring members to supply the stirred developer-tank-contained developer to an electrostatic latent image holder, comprising:

a developer replenishing tank for replenishing the toner and the carrier to said developer tank, a toner concentration detecting sensor for detecting the current toner concentration inside said developer tank, a discharging mechanism provided in said developer tank to discharge an excessive amount of the developer-tank-contained developer outside said developer tank when the amount of the developer-tank-contained developer inside said developer tank exceeds a predetermined amount, and control unit for carrying out control to replenish the toner and the carrier from said developer replenishing tank to said developer tank when said current toner concentration detected using said toner concentration detecting sensor is lower than a predetermined reference toner concentration, wherein when a toner concentration higher than said reference toner concentration by a predetermined value or more is detected as said current toner concentration, said control unit corrects said reference toner concentration to a corrected reference toner concentration higher than said reference toner concentration and changes said corrected reference toner concentration so that said corrected reference toner concentration gradually lowers to the value of said reference toner concentration.

2. The developing device according to claim 1, wherein said corrected reference toner concentration is a value obtained by subtracting a predetermined value from said current toner concentration that is detected being higher than said reference toner concentration by said predetermined value or more.

3. The developing device according to claim 1, wherein said control unit corrects said corrected reference toner concentration to a lower value each time predetermined amounts of the toner and the carrier are replenished to said developer tank.

4. The developing device according to claim 1, wherein said developing device further comprises a developer discharge detecting sensor to detect whether the developer-tank-contained developer has been discharged from said discharging mechanism, and said control unit corrects said corrected reference toner concentration to a lower value each time said developer discharge detecting sensor detects the discharge of the developer-tank-contained developer.

5. The developing device according to claim 1, wherein said control unit gradually corrects the value of said corrected reference toner concentration to lower values with the passage of time.

6. An image forming apparatus having a rotatable electrostatic latent image holder for holding electrostatic latent images on the circumferential face thereof, stirring members for stirring a developer-tank-contained developer containing toner and carrier inside a developer tank while conveying said developer, and a developer holder disposed adjacent to said stirring members to supply the stirred developer-tank-contained developer to said electrostatic latent image holder, comprising:

a developer replenishing tank for replenishing the toner and the carrier to said developer tank, a toner concentration detecting sensor for detecting the current toner concentration inside said developer tank, a discharging mechanism provided in said developer tank to discharge an excessive amount of the developer-tank-contained developer outside said developer tank when the amount of the developer-tank-contained developer inside said developer tank exceeds a predetermined amount, control unit for carrying out control to replenish the toner and the carrier from said developer replenishing tank to said developer tank when said current toner concentration detected using the toner concentration detecting sensor is lower than a predetermined reference toner concentration, wherein when a toner concentration higher than said reference toner concentration by a predetermined value or more is detected as said current toner concentration, said control unit corrects said reference toner concentration to a corrected reference toner concentration higher than said reference toner concentration and changes said corrected reference toner concentration so that said corrected reference toner concentration gradually lowers to the value of said reference toner concentration.

7. The image forming apparatus according to claim 6, wherein said corrected reference toner concentration is a value obtained by subtracting a predetermined value from said current toner concentration that is detected being higher than said reference toner concentration by said predetermined value or more.

8. The image forming apparatus according to claim 6, wherein said control unit corrects said corrected reference toner concentration to a lower value each time predetermined amounts of the toner and the carrier are replenished to said developer tank.

9. The image forming apparatus according to claim 6, wherein said developing device further comprises a developer discharge detecting sensor to detect whether the developer-tank-contained developer has been discharged from said discharging mechanism, and said control unit corrects said corrected reference toner concentration to a lower value each time said developer discharge detecting sensor detects the discharge of the developer-tank-contained developer.

10. The image forming apparatus according to claim 6, wherein said control unit gradually corrects the value of said corrected reference toner concentration to lower values with the passage of time.

11. The image forming apparatus according to claim 6, wherein said control unit gradually corrects the value of said corrected reference toner concentration to lower values depending on the number of image formation operations.

12. A developing method applied to a developing device having stirring members for stirring a developer-tank-contained developer containing toner and carrier inside a developer tank while conveying said developer and a developer holder disposed adjacent to said stirring members to supply the stirred developer-tank-contained developer to an electrostatic latent image holder, and a developer replenishing tank for replenishing the toner and the carrier to a developer tank, comprising the steps of:

detecting the current toner concentration inside said developer tank, replenishing the toner and the carrier from said developer replenishing tank to said developer tank when said current toner concentration detected using said toner concentration detecting sensor is lower than a predetermined reference toner concentration, discharging an excessive amount of the developer-tank-contained developer outside said developer tank using said discharging mechanism disposed in said developer tank when the amount of the developer-tank-contained developer inside said developer tank exceeds a predetermined amount, correcting said reference toner concentration to a corrected reference toner concentration higher than said reference toner concentration when a toner concentration higher than said reference toner concentration by a predetermined value or more is detected as said current toner concentration, and changing said corrected reference toner concentration so that said corrected reference toner concentration gradually lowers to the value of said reference toner concentration.

13. The developing method according to claim 12, wherein said corrected reference toner concentration is corrected to a lower value each time predetermined amounts of the toner and the carrier are replenished to said developer tank.

14. The developing method according to claim 12, wherein the value of said corrected reference toner concentration is gradually corrected to lower values with the passage of time.

* * * * *